United States Patent [19]

Kaufmann

[11] 3,967,773

[45] July 6, 1976

[54] STORAGE METHOD EMPLOYING SEVERABLE WALLED CONTAINER HAVING A CONTINUOUSLY MERGIBLE COVER

[76] Inventor: David P. Kaufmann, 6760 N. 54th St., Milwaukee, Wis. 53223

[22] Filed: Jan. 20, 1975

[21] Appl. No.: 542,597

Related U.S. Application Data

[63] Continuation of Ser. No. 330,998, Feb. 9, 1973, abandoned.

[52] U.S. Cl. ..... 229/51 DB; 53/38; 229/5.5; 229/39 R; 229/43; 229/51 TS

[51] Int. Cl.[2] ..... B65D 5/54

[58] Field of Search ..... 426/122; 229/51 DB, 229/51 TS, 38, 39 R, 43, 5.5; 53/38

[56] References Cited

UNITED STATES PATENTS

| | | | |
|---|---|---|---|
| 687,643 | 11/1901 | Megloughlin et al. | 229/51 DB |
| 2,847,151 | 8/1958 | Meyer-Jagenberg | 229/43 |
| 2,853,223 | 9/1958 | Paflas | 229/43 |
| 2,896,837 | 7/1959 | Risucci | 426/122 |
| 2,903,173 | 9/1959 | Hopkins | 229/5.5 |
| 3,137,437 | 6/1964 | Svensson | 229/51 DB |
| 3,168,234 | 2/1965 | Bartz | 229/51 DB |
| 3,283,942 | 11/1966 | Collie | 229/43 |
| 3,539,093 | 11/1970 | Massengill | 229/51 TS |

*Primary Examiner*—William Price
*Assistant Examiner*—Bruce H. Bernstein
*Attorney, Agent, or Firm*—Andrus, Sceales, Starke & Sawall

[57] ABSTRACT

A container includes a tubular body section having a plurality of parallel and equally spaced encircling tear lines for tearing of the successive sections from the rest of the container. A telescoping cover closes an open top. The cover has a side wall of the depth of one section and a top wall projecting inwardly into the side wall with an inclined inner side wall so as to project into the container and also define a stacking recess. The bottom wall conforms to the stacking recess and permits convenient stacking. The inward projection of the cover permits the effective minimizing of the air space within the container as the material is removed.

4 Claims, 5 Drawing Figures

STORAGE METHOD EMPLOYING SEVERABLE WALLED CONTAINER HAVING A CONTINUOUSLY MERGIBLE COVER

BACKGROUND OF THE INVENTION

This application is a continuation of application Ser. No. 330,998 filed Feb. 9, 1973, now abandoned.

The present invention relates to a container including means to permit successive removal of one or more wall portions and thereby provide selective reduction of the height of the container and particularly to such a container having a special top cover and bottom wall construction.

In the packaging of food and other similar products which are selectively removed in relatively small quantities over a period of time, the products become spaced from the opening and it becomes progressively more difficult and awkward to remove the material. Furthermore, as the material is removed, the container volume is, of course, greater than that necessary to store the remaining product, creating excess storage space. Further, food containers for ice cream and similar products, which are adversely affected by air and the like, when partially filled subject the stored products to loss of flavor and other similar adverse effects. For example, in the storage of ice cream not only is there a noticeable effect in the flavor but the upper surface which is exposed to the air in the top portion of the container from which the ice cream has been dispensed is subject to crystallization. Further, food products are generally displayed in stacked relation. It would be desirable to permit the interlocking stacked relationship to provide a firm and stable stack of the product.

Various suggestions have been made with respect to a reduceable type carton, for example, as shown in U.S. Pat. No. 3,173,437. Such units permit only the physical reduction in the size of the container and have not provided for optimum minimizing of the air space or of the exposed surface. Further, they do not provide stable interrelationship of a plurality of stacked cartons.

Summary of the Present Invention

The present invention is particularly directed to a reduceable container having severable wall parts and a removable telescoping top cover which, in combination, permits the continuous optimum minimizing of the air within the upper portion of the container and also permitting a reliable interconnected stacking of the several containers.

Generally, in accordance with the present invention, the container includes a tubular body section of any desired cross-section having a plurality of parallel and axially spaced severing lines. Each line is preferably in the form of a thin line section providing a weak die cut or tear line to permit manual tearing of the successive parts from the rest of the container. The several lines are equally spaced to provide for reduction of the container in generally equal increments. The container is formed with an open top having the telescoping cover which has a side wall preferably corresponding in depth essentially to the depth of one of the divisible or severable wall parts. The top wall of the cover, in turn, projects inwardly into the side wall of the cover preferably with an inclined inner side wall to define a projection into the container and also a stacking recess of a generally frustum cross-section. The bottom wall of the container preferably generally conforms to the stacking recess defined by the inwardly projecting top wall of the cover. This permits convenient stacking. More important, the inward projection of the cover permits the effective minimizing of the air space within the container as the material is removed. Thus the depending side wall permits the placement of the cover with less than a total overlap of the side wall and the container. As the material is removed the cover telescopes downwardly over the container and with the projection moving inwardly toward the upper surface of the stored material. With the side wall generally approximating the depth of the severable portions of the container, the inwardly projecting portion of the cover may be maintained in close spacement or actual engagement with the stored material and thereby minimizes any excess exposure. Further, in connection with ice creams and similar products where the material is normally removed by a scooping procedure and the material is not such as to settle within the container, the material will normally extend upwardly along the side walls slightly. The special construction of the inward projection with an inclined wall to define a frustum recess will permit the curved stored material to move upwardly between the projection and the side wall of the container and thereby permit the close placement of the cover to the stored material.

This combination thereby provides a highly improved system particularly for the storage of ice cream and the like which is adversely affected by air conditions. The container may, however, be applied to any other product and particularly food products such as cheese products as well as butter and oleomargarine, mayonaise or salad dressings, shortening products and the like where relatively large quantities are used in successive relatively small quantities.

Thus the present invention provides a highly improved container which can be particularly adapted to the storage and dispensing of food products but which may of course be applied to any other material in which it is desired to permit removal of a part of the container as the material is removed.

BRIEF DESCRIPTION OF THE DRAWING

The drawing furnished herewith illustrates a preferred construction of the present invention in which the above advantages and features are clearly disclosed as well as others which will be readily understood from the following description of the illustrated embodiment.

In the drawing.

DESCRIPTION OF ILLUSTRATED EMBODIMENT

Figure 1:
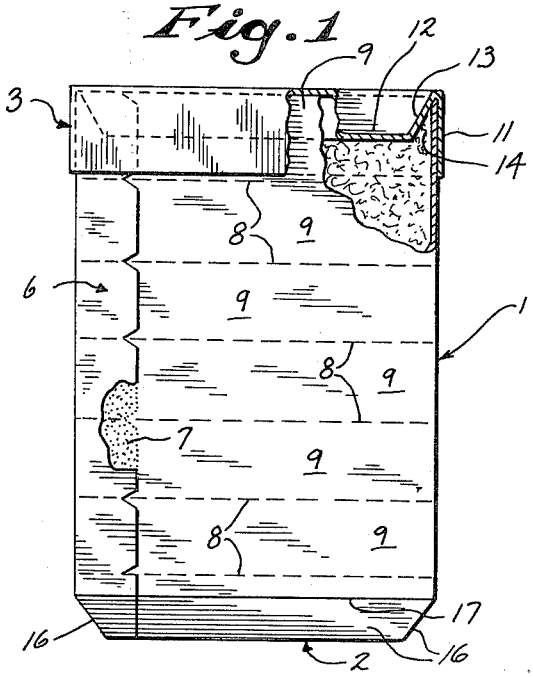
FIG. 1 is an elevational view of a container constructed in accordance with the present invention.
Figure 2:
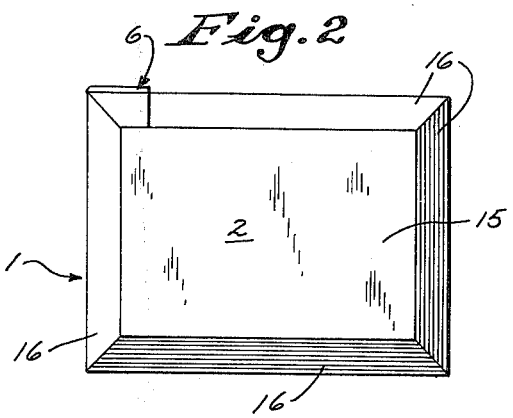
FIG. 2 is a bottom view of the container.
Figure 3:
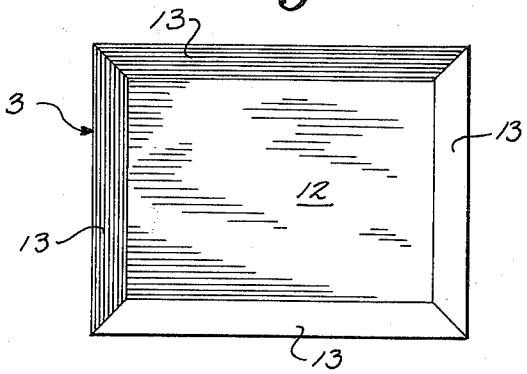
FIG. 3 is a top view of the container.
Figure 4:
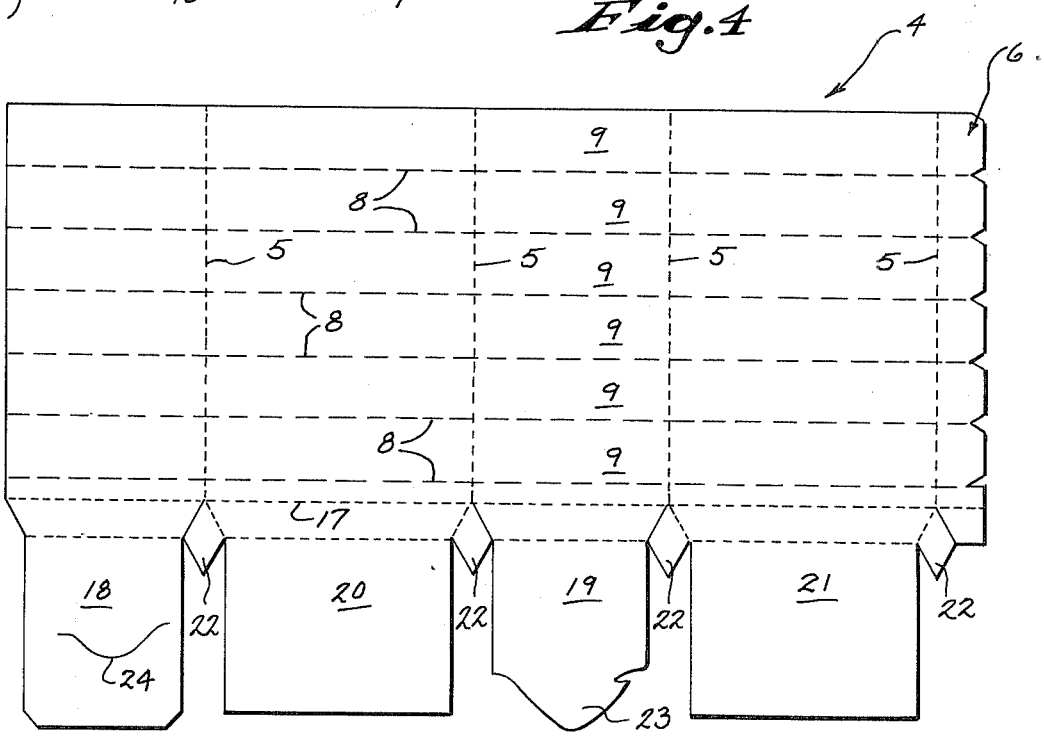
FIG. 4 is a plan view of a blank from which the container of FIGS. 1 – 3 is constructed.

Referring to the drawing and particularly to FIG. 1, the container of the present invention is illustrated including a generally rectangular tubular body 1, the lower end of which is closed by a bottom wall 2. The top of the body 1 is open and is releasably closed by a telescoping cover 3. The side wall portion of the container body 1 and the bottom wall 2 are preferably integrally formed from a suitable blank 4, as shown in FIG. 4. In the illustrated embodiment of the invention, the container 1 is formed with a generally rectangular horizontal cross-section but, of course, can have any desired cross-section. To form the generally rectangular body, the blank 4 includes a plurality of parallel fold lines 5 corresponding to the four vertical edges of the container. In addition, a tab section 6 is formed extending outwardly along one edge of the blank from one of the fold or crease lines. The blank 4 is folded along the crease line 5 with the tab portion 6 overlapping the opposite side wall or the adjacent side wall defined by the opposite portion of the blank. A suitable adhesive 7 may be interposed between the tab 6 and the side wall of the body 1 to releasably attach the tab and provide a complete enclosure. The adhesive 7 is preferably such that the tab portion 6 can be removed from the adjacent side wall by manual pulling thereon.

In accordance with the present invention, the body or side wall of the container 1 is provided with a plurality of severing lines 8 extending completely throughout the body portion including the tab portion 6. The lines 8 define a plurality of adjacent similar severable body portions 9 in body 1. The tear or severing lines 8 may be formed in any suitable manner depending upon the material employed for the carton. In any event they provide a weakened portion which permits the removal of the corresponding portion from the adjacent portions. For example, where the container is formed of a cardboard-like material conventionally employed in ice cream cartons and the like, the separation lines 8 can be an interrupted die cut line, as illustrated. If the die cut construction is such as to completely pass through the container wall, a liner or other coating may be provided on the inside or outside of the container to effectively seal the container.

Further the tab portion 6 is preferably formed with edge notches aligned with and at the terminal end of the severing lines 8. Thus, when it is desired to remove the upper end portion or part of the container body 1, the user merely grasps the appropriate tab portion 6, and by pulling thereon releases the tab from the adhesive connection to the side wall of body 1 and by the continued pulling tears the strip along the cut lines 8.

The cover 3 is formed of a material generally corresponding to that of the body 1, or of any other suitable compatible material. The cover 3 of this invention includes a tubular encircling side wall 11 which is adapted to telescope over the upper end of the container 1. The depth of the side wall 11 is preferably at least equal to the depth of a severable portion 9, such that it can telescope over the unit for the complete depth of a several portion. The side wall is integrally formed with an outer top base wall 12 having an inner slanted or inclined side wall 13 connecting the walls 11 and 12. The depth of the wall 13 is slightly less than that of the side wall 11 and defines an inner cover projection with a frustum cross-section. The inward cover projection with the inclined inner wall 13 provides a slight spacing or gap between wall 13 and the side wall of the body 1, as shown at 14. With the container body 1 completely filled, the base wall 12 of cover 3 may rest on the upper end of the material with the side wall 11 depending downwardly over the body 1 of the container to maintain a complete enclosure of the material. When the stored material is withdrawn, the cover 3 and particularly the cover projection moves into the body to maintain a minimum space between the stored material and the cover. This creates a minimal air volume within the unit to provide improved storage.

The inclined wall 13 also permits ready placement and removal of the cover 3 if the upper portion of the container is deformed or bent inwardly. Further, the wedge or the inverted V-shaped space 14 also defines a small area within which the stored material may accumulate immediately adjacent the interior side wall of the uppermost body section 9. Thus, in removing ice cream or similar products, it is conventional to employ a scooping device which is brought through the material and up against and along the side wall. This may result in a slight accumulation of material along the side wall which can be readily accommodated by the special recess provided. When the material is removed below the level of the uppermost body section or part 9, the corresponding tab 6 is released and by pulling the section removed to permit the continued optimum storage.

Figure 5:
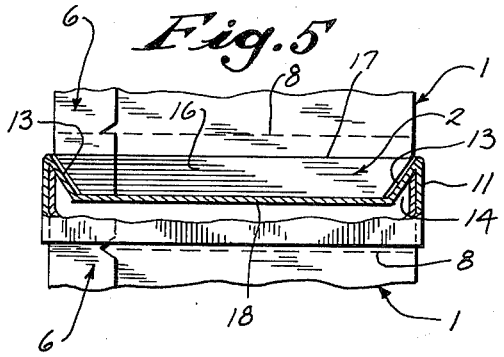
FIG. 5 is a fragmentary view showing the upper portion of one container and the lower portion of another container arranged in stacked relation.

The bottom wall 2 is preferably integrally formed with the side wall of the body 1 or otherwise suitably secured thereto. In the illustrated embodiment of the invention, the bottom wall is generally frustum-shaped with a flat bottom wall 15 and angularly inclined side walls 16 which extend upwardly therefrom to a bottom encircling fold line 17 to correspond generally to the recess in the cover 3. The fold line 17 may be formed simultaneously with the severing lines 8. The bottom wall structure may conveniently be formed from a plurality of flaps 18 – 21 integrally formed with the blank 4 as shown in FIG. 4. Thus, a first pair of opposed flaps 18 and 19 extend from the opposite side walls of body 1 in the blank as defined by the fold line 5. The first pair of opposed flaps 18 and 19 are folded inwardly to form the inner bottom portion. The second pair of opposed flaps 20 and 21 extend from the adjacent opposite side walls of body 1 and are separated from the first pair by suitable die cut portions 22, shown generally as rectangular cutouts with diamond shaped connections to the bottom fold line 17. The opposite flaps 20 and 21 are folded as exterior wall members and provided with interlocking projection 23 and slot 24 to permit the conventional interconnection. The frustum section of the bottom wall thus conforms to the frustum recess in the top cover 3 and provides stable stacking of the containers, for example, as shown in FIG. 5.

The special combination of the removable cover and the severable portions of the container provide a highly improved arrangement wherein a minimum amount of storage space is required to store the material, singly or in a plurality of stacked containers while maintaining a most efficient enclosure of the stored material within each container. For example, the device is particularly useful for the home storage of ice cream products and the like wherein the user normally has a plurality of different flavors with a separate container for each flavor. In such case, it is desirable to have a minimum amount of storage volume in order to make mose efficient use of the freezer. The remaining size of the container is also a direct indication of the remaining material on hand and will assist the user in providing monitoring when an additional product purchase is desirable without the necessity of actually opening the container.

In the illustrated embodiment, the container body is shown as formed integrally with the bottom. The body may, of course, be separately formed and attached to a suitable separate bottom unit. For example, the body may be formed of molded plastic, formed paper or other suitable material into a suitable tubular member, with the top and bottom unit separately molded into an appropriate shape for attachment to the separate body. The bottom could be attached with a suitable adhesive.

The material employed for the several components may be the same or completely different materials and may, of course, be plastic, metal, paper, composition and mixtures thereof as required by the particular application.

The present invention thus provides a highly improved and reliable several container for the storage of various food products, or other products and the like.

Various modes of carrying out the invention are contemplated as being within the scope of the following claims, particularly pointing out and distinctly claiming the subject matter which is regarded as the invention.

I claim:

1. In the method of storing a successively removed product from a severable container having a tubular body of a constant cross-section and having a plurality of encircling severable parallel lines defining similar sequentially removable body portions for reducing the depth of the container and defining similar end body portions, the steps providing a replaceable cover telescoped over one end body portion of said container, said cover having an outer encircling side wall of essentially the same cross-section and slidably telescoping over each of said end body portions formed by removal of a body portion, said replaceable cover having an inner projecting wall portion connected to said outer encircling side wall and projecting inwardly to an inner base wall, said inner projecting wall portion extending into the adjacent end body with said cover side wall projecting over the body portion, the depth of said inner projecting wall portion being less than the depth of the outer encircling side wall, successively removing said product, and replacing said cover over the end body portion as the level within the container is reduced until said inner base wall abutts the products, and removing a body portion at least when the product is below a severable line to continuously maintain a minimal gap between the base wall of the cover and the product.

2. The method of claim 1 wherein said inner projecting wall portion of said cover includes an angled side wall connected to said outer side wall and extending inwardly of the outer side wall to an inward inner base portion substantially spanning the container opening and employing angled side wall to guide the cover onto the containers.

3. A severable container for enclosing of a product comprising a tubular body of a constant cross-section and having a plurality of encircling severable parallel lines defining similar sequentially removable body portions for reducing the depth of the container and defining similar end body portions, closure means for the opposite ends of said container with at least one of said closure means including a replaceable cover telescoped over the end body portion and having an outer encircling side wall of essentially the same cross-section and adapted to slidably telescope over each of said end body portion including such end body portion formed by removal of a body portion, said replaceable cover having an inner projecting wall portion connected to said outer encircling side wall and projecting inwardly to an inner base wall, said inner projecting wall portion extending into the adjacent end body with said cover side wall projecting over the body portion, the depth of said inner projecting wall portion being less than the depth of the outer encircling side wall, said cover being variably slidably telescoped over the end body portion as the level within the container is reduced to maintain a minimal gap between the inner base wall of the cover and the product.

4. The container of claim 3 having a bottom wall integrally formed with the side walls of the container and projects downwardly below the lowermost severing line and includes a fold line parallel to and spaced from said severing line, said bottom wall having an inclined wall extending downwardly and inwardly from said fold line to a plurality of overlapping flaps located in face-to-face contact and including interconnecting slots in the two outermost layers for said closing of said bottom wall.

* * * * *